US007087871B2

(12) United States Patent
Cherry

(10) Patent No.: US 7,087,871 B2
(45) **Date of Patent: *Aug. 8, 2006**

(54) MICROWAVE OVEN CLEANER

(76) Inventor: John-Paul Francis Cherry, 3203 Oak Bough Ln., Missouri City, TX (US) 77459-4655

( * ) Notice: Subject to any disclaimer, the term of this patent is extended or adjusted under 35 U.S.C. 154(b) by 54 days.

This patent is subject to a terminal disclaimer.

(21) Appl. No.: 10/701,336

(22) Filed: Nov. 4, 2003

(65) Prior Publication Data

US 2004/0094540 A1 May 20, 2004

Related U.S. Application Data

(63) Continuation of application No. 09/923,511, filed on Aug. 7, 2001, now Pat. No. 6,656,288.

(60) Provisional application No. 60/225,709, filed on Aug. 16, 2000.

(51) Int. Cl.
*H05B 6/64* (2006.01)

(52) U.S. Cl. ..... 219/678; 134/1

(58) Field of Classification Search ..... 219/678; 134/1, 11, 12, 17, 31, 34–35, 2, 96.1, 105; 422/1, 21; 428/34.2; 229/5.81, 903
See application file for complete search history.

(56) References Cited

U.S. PATENT DOCUMENTS

| | | | | |
|---|---|---|---|---|
| 3,753,651 | A | 8/1973 | Boucher | |
| 4,481,395 | A | 11/1984 | Smith et al. | |
| 4,560,850 | A | 12/1985 | Levendusky et al. | |
| 4,633,052 | A | 12/1986 | Beavers et al. | |
| 4,721,140 | A | 1/1988 | Coker | |
| 4,778,968 | A | 10/1988 | Torres | |
| 4,861,956 | A | 8/1989 | Courneya | |
| 5,007,529 | A * | 4/1991 | Spector | 206/0.5 |
| 5,290,985 | A | 3/1994 | Jancic et al. | |
| 5,313,878 | A | 5/1994 | Strait | |
| 5,425,972 | A | 6/1995 | Calvert | 428/34.2 |
| 5,432,324 | A | 7/1995 | Freewald | |
| 5,436,434 | A | 7/1995 | Baird | |
| 5,558,798 | A | 9/1996 | Tsai | |
| 6,322,748 | B1 | 11/2001 | Hutton et al. | 422/1 |
| 6,444,963 | B1 | 9/2002 | Donahue | 219/678 |
| 6,656,288 | B1 * | 12/2003 | Cherry | 134/1 |
| 6,878,910 | B1 | 4/2005 | Kim et al. | |
| 2002/0113067 | A1 | 8/2002 | Donahue | |
| 2002/0176794 | A1 | 11/2002 | Donahue | 422/5 |

FOREIGN PATENT DOCUMENTS

| | | | |
|---|---|---|---|
| DE | 3937720 | A * | 5/1991 |
| DE | 3937720 | A1 | 5/1991 |

(Continued)

OTHER PUBLICATIONS

Greer, B., Agricultural Extension service, University of Tennessee-Jan. 1999.

(Continued)

*Primary Examiner*—Quang Van

(57) ABSTRACT

A device and method that cleans microwave ovens through a chemical action, specifically to an agent that is placed into the microwave oven, and then activated by operating the oven for a period of time. Different embodiments include a devise composed of an open cell container filled with solution; an open cell container with an attached sponge(s) and filled with solution; and a sponge that contains a cleaning solution in hydrant or dehydrated form. In some of the described embodiments, the devise has a tear off membrane seal to maintain the solution within the cell prior to use. Another embodiment described has a bottle hanger attached to a cell. All embodiments maintain a process to absorb excess microwave energy.

67 Claims, 3 Drawing Sheets

FOREIGN PATENT DOCUMENTS

| | | | | |
|---|---|---|---|---|
| DE | 3937720 | A1 | | 5/1991 |
| DE | 4008919 | A1 | | 9/1991 |
| EP | 0428024 | A2 | | 5/1991 |
| JP | 10-229963 | A | | 9/1998 |
| JP | 10-316177 | | | 12/1998 |
| JP | 10314092 | A | * | 12/1998 |
| JP | H10-314092 | | | 12/1998 |
| JP | 2000-082580 | | | 3/2000 |
| JP | 2000-85854 | | | 3/2000 |
| JP | 2000-085854 | A | | 3/2000 |
| JP | 2000082580 | A | * | 3/2000 |
| JP | 2000-126700 | | | 5/2000 |
| JP | 2004170053 | | | 6/2004 |
| KR | 118075 | Y | | 4/1998 |
| WO | WO 98/03622 | A2 | | 1/1998 |

OTHER PUBLICATIONS http://homeparents.about.com/c/ht/00/07/How__Clean__Microwave__Oven0962934268. htm—,date not provided.

http://www.mouthshut.com/readreview/10138-1. html—May 2001.

Easy-Off Heat-Activated Microwave Wipes press release—Sep. 4, 2002.

Easy-Off Heat-Activated Microwave Wipes advertisement—Sep. 14, 2002.

http://www.easyoff.us/whatsnew.shtml—Aug. 27, 2004.

http://www.cadie.com/sponge__microwave__.html—Jul. 2005.

* cited by examiner

MICROWAVE OVEN CLEANER

CROSS-REFERENCE TO RELATED APPLICATIONS

This application is a continuation of U.S. patent application Ser. No. 09/923,511, filed Aug. 7, 2001 now U.S. Pat. No. 6,656,288, which claims benefit of U.S. provisional patent application Ser. No. 60/225,709, filed Aug. 16, 2000. Each of the aforementioned related patent applications is herein incorporated by reference.

BACKGROUND OF THE INVENTION

Food residue is often found coating the inside of microwave ovens, especially industrial, commercial and educational settings. Over time, the accumulation of the food produces an unsightly mess that is also difficult to clean, as the material is repeatedly dehydrated to aggressively adhere to the surface. Attempts to scrub away the particulate by conventional method (i.e. abrasive sponge with soap and water) are time-consuming and may damage the plastic walls of the microwave. The process is also difficult because the worse part of the mess is often on the top of the oven, the area that is the hardest to see and clean. While microwave ovens have become symbolic of being quick and easy to use, the same is not true of cleaning them.

This problem has been noticed and several patents have been issued applying alternative solutions.

PRIOR ART

Several patents have been issued to address this problem. U.S. Pat. Nos. 4,481,395 and 5,290,985 keep the walls of the microwave oven clean by placing inserts into the oven, relying on conventional cleaning methods (washing, scrubbing, drying) to be used when the insert is removed. A dishwasher may be used, if one is around. Also, these devices consume some of the usable volume inside the oven.

In U.S. Pat. Nos. 4,633,052 and 4,778,968, non-flammable, pre-sized, paper is used to cover the floor of microwave oven. Once the paper becomes soiled, it is thrown out and replaced with a new sheet. Though these patents protect the floor, the walls and ceiling are overlooked. The ceiling generally accumulates the majority of the food debris while being the more difficult area to clean.

Furthermore, each of the above-mentioned patents necessitate the device to be custom-dimensioned (in as many as three axes) for use in each different size of microwave oven. This represents a significant limitation.

Other inventions have realized this problem of soiling a microwave oven and have attempted preventive solutions. These inventions, such as U.S. Pat. Nos. 4,721,140 and 5,436,434, use splatter guards to minimize the expulsion of food material onto the inner surfaces of the oven.

U.S. Pat. Nos. 4,560,850, 5,313,878, 5,432,324 and 5,558,798 have been issued for releasing steam or moisture for the use of cooking or steaming food. Also, U.S. Pat. Nos. 3,753,651 and 4,861,956 address the sterilization of surfaces, of items brought into the oven, by the use of microwave radiation and/or steam. All of the above mentioned patents ignore cleaning the interior of the microwave oven.

It is therefore desirable to have a simple, quick, low-cost means of cleaning a microwave oven that saves effort to clean the oven while not disturbing normal microwave activities. Moreover, the power of the oven should be utilized to clean itself. The device should not require customization or resizing to work in different sizes of microwave ovens. All materials should be non-toxic, so any residues would not pose a threat to health.

SUMMARY OF THE INVENTION

The instant invention is a cleaning device consisting (in its simplest form) of an open cell container used to hold a non-toxic, aqueous solution that may contain surfactant(s) such as TERGITOL® 15-S-9, d-limonene and/or an emulsifier such as ethoxylated-soybean oil. Details are provided below. The method of use is to place the device into the microwave oven that is then turned on for approximately five minutes, followed by a period of an additional five minutes while the oven door remains closed, allowing the solution to penetrate the caked-on material. The door is then opened. Food residues, which previously held aggressively to the interior of the oven, may be thoroughly wiped clean with a soft sponge or towel. Many residues fall off. The invention works impressively well.

There are four factors to the efficaciousness of the invention: 1) the vapor phase of the solution, created by heating with microwave energy, has a direct effect of softening the residue by steaming; 2) the surfactant is borne by the vapor phase of the solution to the residue at any location in the oven, where it bonds to any remaining oils; 3) the "cool-down" period allows the solution to leave the vapor phase, condense and penetrate more deeply into the residue, also carrying surfactant deeper inside; 4) the wiping down phase, in which the heated solution remaining in the device is used to wipe down the surfaces of the oven. During the vapor phase, any fragrance or scent is distributed throughout the room in which the oven resides. The result is a highly efficacious, low cost, non-toxic, microwave oven cleaning method. The volume of solution used for a cleaning must be sufficiently small so that it will boil for a predominance of the on-time of the oven (during cleaning), in the range of 80–100 mL. The volume of the solution must be in accord to the cooking time and concentration of surfactant. Though some of the surfactant will be borne onto the interior surfaces of the oven, much will remain dissolved in the solution of the reservoir. The surfactant will slow the loss of water in the reservoir; therefore, maintaining a protective material for excess microwave energy.

In the solution, the proposed surfactants are non-toxic, making the invention completely safe in the event any residues are left after the cleaning process. Scent such as lemon or pine may be added to produce a pleasant smell. Antibacterial compound may be added without degrading the effectiveness of the process.

Several embodiments are disclosed for an open-cell container including: a simple dispenser with a tear-off membrane seal; a sponge that is soaked with solution; an integrated dispenser and sponge with a tear-off cover; an integrated dispenser and sponge in which the solution is released by penetrating the sponge; a dispenser with a fill line and sponge; and a dispenser with an attached bottle hanger and sponge.

DETAILED DESCRIPTION OF THE DRAWINGS

Figure 1:
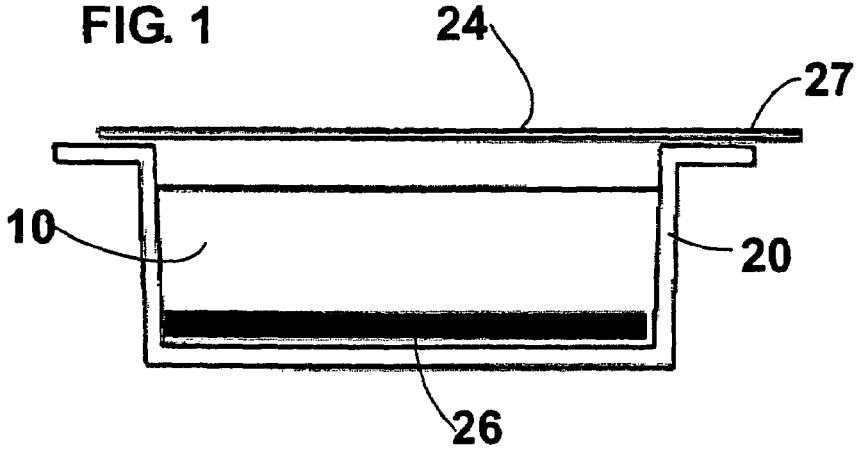
FIG. 1 shows a section through a microwave oven cleaner device made of a dispenser with a tear-off membrane seal containing the cleaning solution.

FIG. 1 shows the solution 10 in a disposable dispenser 20 with a tear-off membrane seal 24. To open, tear tab 27. A gelatinous material 26 prevents damage to the microwave if solution 10 is boiled away well before heating cycle ends, preventing damage to the oven.

The dispenser 20 with tear-off membrane seal 24 maintains solution 10 until time of use. Once the seal 24 is pierced or removed, the apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the interior surfaces of the oven with a sponge, cloth, paper towel, shammy or similar item.

The preferred solution for this embodiment contains approximately, by volume, 96% water, 2% d-limonene and 2% E-Z-MULSE®, an ethoxylated soybean-oil emulsifier (ingredients available from Florida Chemical Co.). d-Limonene is a, non-toxic, citrus scent that also enhances performance due to its surfactant properties. Another embodiment uses a blend surfactant, such as a 1% solution containing 40% TERGITOL® 15-S-9 and 60% TERGITOL® 15-S-15, (available from Union Carbide) in an aqueous base. Emulsifiers may be used to aid surfactants while dissolving in the aqueous solution. A non-blend embodiment uses TRITON® X301, also from Union Carbide. Antibacterial agents, such as triclosan, or other additives, such as ammonia, are also obvious to include as an option. Surfactant concentrations in the range of 0.5% to 50% are also obvious to include as an option.

While a microwave oven operates, substances containing water, generally food, absorbs microwave energy. Excess microwave energy will destroy a microwave oven. Concentration of dissolved surfactant may be altered such to slow the rate of evaporation of solution 10 and allow the absorption of excess microwave energy. The gelatinous material 26 also absorbs excess energy and may be used with solution 10 to curtail dehydration of solution 10. The collaborative effort of solution 10 and the gelatinous material 26 produces a larger, therefore safer, interval to operate and clean the oven than solution 10 alone.

The dispenser 20 could be made from a variety of materials including plastic, paper, cardboard, glass, ceramic or other microwave-safe materials.

Figure 2:
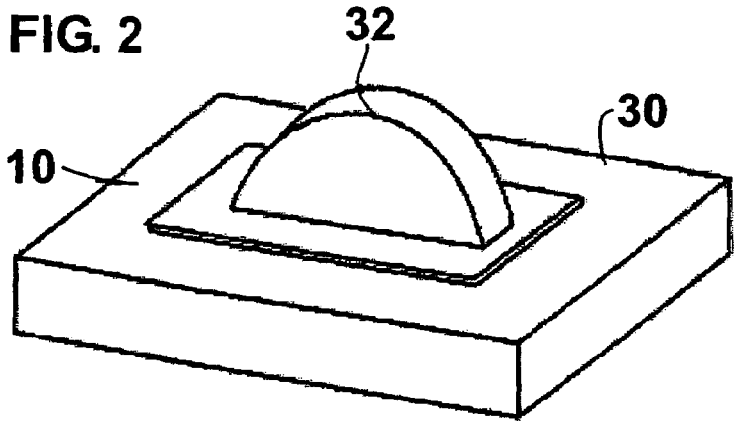
FIG. 2 shows a microwave oven cleaner device with the solution in a sponge.

FIG. 2 shows solution 10 soaked in a sponge 30 with a plastic handle 32 attached by prongs that penetrate the sponge 30. The sponge is packaged in such a way to prevent drying of the sponge 30 (i.e. plastic wrap found on traditional single wrapped sponges).

The sponge 30 would be removed from plastic wrap just prior to using and placed into the oven. The vapor phase has begun once the oven is started. During this phase, a portion of solution 10 will vaporize and leave the sponge 30. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by using the sponge 30, and the remaining heated solution 10 inside of sponge 30, to wipe off the interior surfaces of the oven. The device may also be produced with the surfactant in the sponge and sold in a dehydrated state, reducing weight to save on shipping cost. The product would be wetted prior to use. The handle 32 may be omitted.

Figure 3:
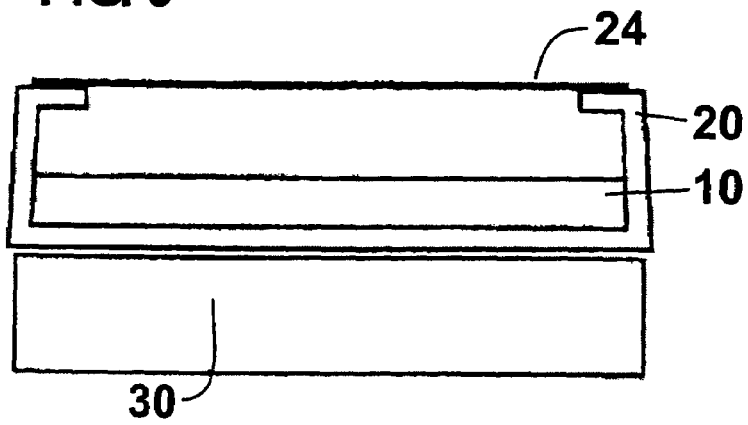
FIG. 3 shows a section through a microwave oven cleaner device including a dispenser with a tear-off membrane seal and an integral clean-up sponge.

FIG. 3 shows a disposable dispenser 20 with a tear-off membrane seal 24 containing the solution 10 and a sponge 30 integrated into the back of the dispenser 20.

The dispenser 20 with tear-off membrane seal 24 maintains solution 10 until time of use. Once the seal 24 is pierced or removed, the apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the interior surfaces of the oven with attached sponge 30.

Figure 4:
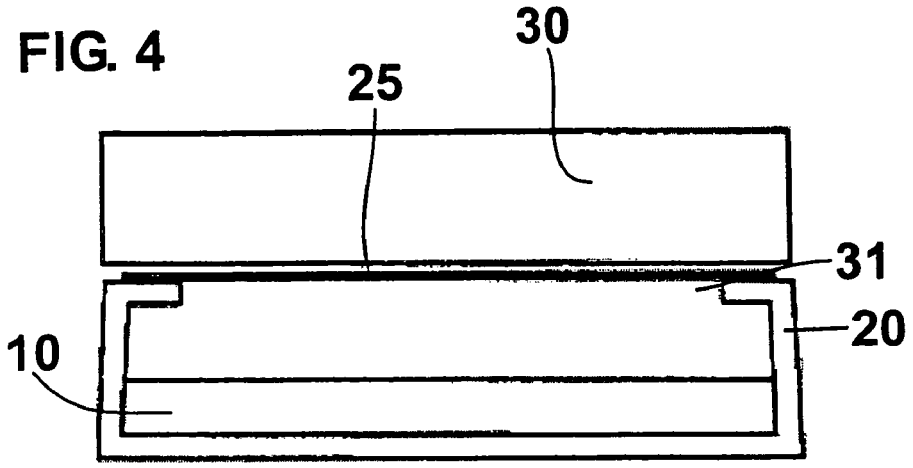
FIG. 4 shows a section through a microwave oven cleaner device including a dispenser with a cut through membrane seal and an integral clean-up sponge.

FIG. 4 shows a sponge 30 attached to the open face 31 of disposable dispenser 20. A cut through membrane 25 lies between sponge 30 and disposable dispenser 20. The product may be opened with a fork or knife plunged into sponge 30 and through membrane 25. This allows the sponge 30 to be wetted with solution 10 that may be volatile, such as ammonia, yet stored. The dispenser 20 may be shaped as a handle. A heavy surfactant can be used in the solution 10 in this embodiment.

The dispenser 20 with membrane seal 25 maintains solution 10 until time of use. Once the seal 25 is pierced and the solution 10 moistens the sponge 30, the apparatus is placed into the microwave oven and activated by running the oven. The vapor phase has now started. During this phase, a portion of solution 10 will vaporize and leave the sponge 30. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by holding the dispenser 20 and wiping down the interior surfaces of the oven with attached sponge 30.

Figure 5A:
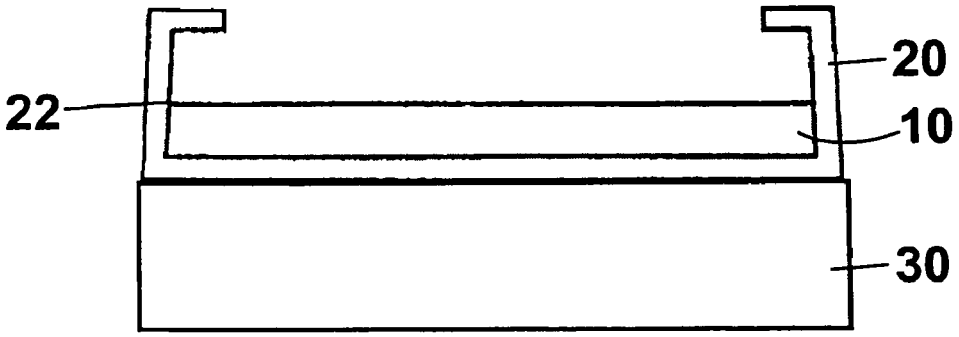
FIG. 5A shows a section through a microwave oven cleaner device made of a dispenser, solution, sponge and fill-line.

FIG. 5A shows a dispenser 20 with solution 10 and attached sponge 30. Such dispenser could be filled with solution 10 at time of use. A fill line 22 is used to define the preferred volume of solution 10 to be added. The attached sponge 30 is optional.

At time of use, the dispenser 20 is occupied with solution 10 at a preferred volume marked by the fill line 22. The apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the surfaces of the oven with sponge 30, cloth, paper towel, shammy or similar item.

Figure 5B:
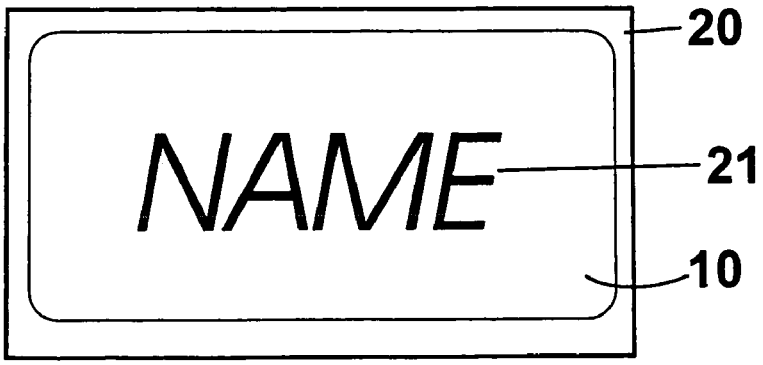
FIG. 5B shows the perspective of looking down into a microwave oven cleaner device of FIG. 5A.

FIG. 5B shows the same device as in FIG. 5A; however, this view is that from above looking down into a dispenser 20 with solution 10. From this perspective, an insignia 21 is noticeable.

Figure 6A:
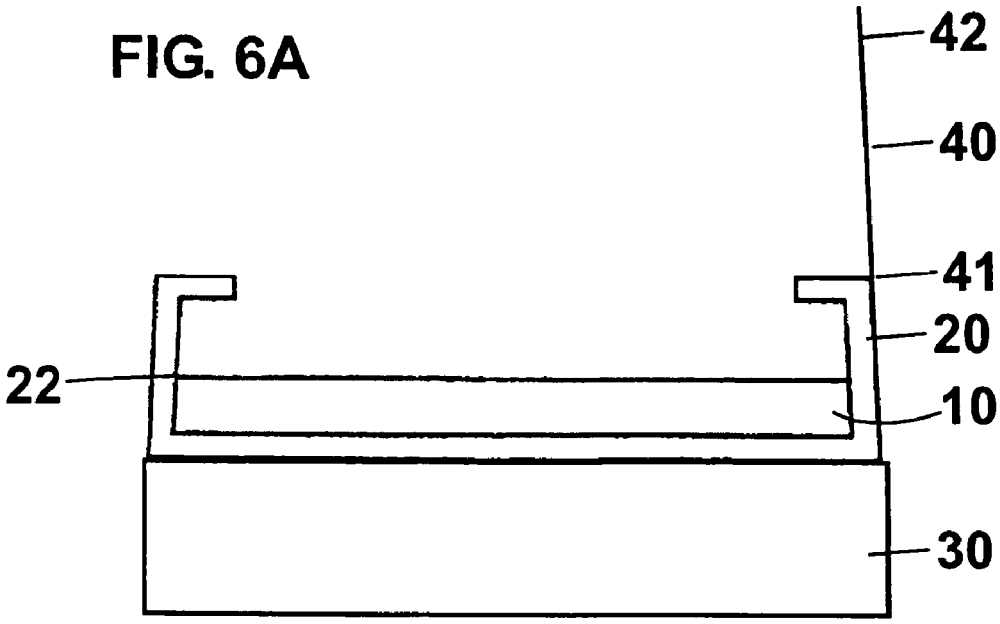
FIG. 6A shows a section through a microwave oven cleaner device made of a dispenser, solution, sponge, fill line and attached bottle hanger.

FIG. 6A shows solution 10 in a disposable dispenser 20 with sponge 30 and an attached bottle hanger 40. The bottle hanger 40 is composed of a fold or perforation 41 and a hole 42 to place over the top of a bottle when stored or distributed for resale. The bottle hanger 40 may be torn off from dispenser 20 via perforated fold 41 without affecting performance of the device. A fill line 22 is used to define the preferred volume of solution 10 to be added. The attached sponge 30 is optional.

At time of use, the dispenser 20 is occupied with solution 10 at a preferred volume marked by the fill line 22. The apparatus is placed into the microwave oven and activated by running the oven. The vapor phase has now started. During this phase, a portion of solution 10 will vaporize and leave the dispenser 20. Surfactant is borne by the vapor phase of solution 10 to the residue at any location in the oven, where it bonds to any remaining oils. An interval to condense allows the solution 10 to leave the vapor phase and penetrate more deeply into the residue, carrying surfactant deeper inside. The wiping down phase is achieved by pouring the remaining heated solution 10 from dispenser 20 and wiping down the interior surfaces of the oven with sponge 30, cloth, paper towel or similar item.

Figure 6B:
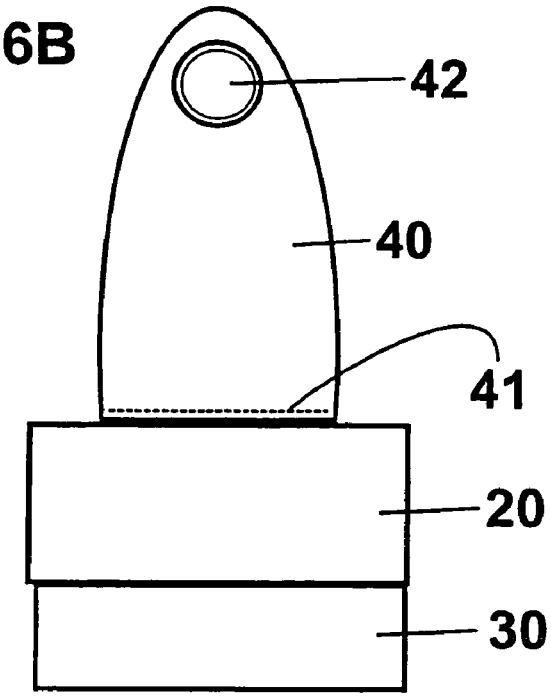
FIG. 6B shows a side-view of a microwave oven cleaner device of FIG. 6A.

FIG. 6B shows the same device of FIG. 6A turned by a 90-degree perspective to one side. Solution 10 is in a disposable dispenser 20 with an attached bottle hanger 40. Bottle hanger 40 is composed of an optional fold or perforation 41 and a hole 42 to place over the top of a bottle.

While the principles of the invention have been made clear in illustrative embodiments, there will be immediately obvious to those skilled in the art, many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits of the true spirit and scope of the invention.

The invention is claimed:

1. An apparatus for cleaning an interior surface of a microwave oven comprising:

an enclosure disposed at least partially around a cleaning article for effecting a cleaning process, wherein the enclosure is breakable; and a cleaning solution comprising a surfactant and compatible with food preparation is in fluid communication with the interior surface of the microwave oven after the enclosure is broken.

2. The apparatus of claim 1, wherein the cleaning article is selected from the group consisting of a sponge, a cloth, paper, a towel, a paper towel, a shammy and combinations thereof.

3. The apparatus of claim 2, wherein the enclosure comprises at least one material selected from the group consisting of plastic, paper, cardboard, glass, microwave-safe materials and combinations thereof.

4. The apparatus of claim 1, wherein the cleaning solution further comprises a fragrance and at least one component selected from the group consisting of water, an emulsifier, an antibacterial agent and combinations thereof.

5. The apparatus of claim 4, wherein the surfactant has a concentration in a range from about 0.5% to about 50%.

6. The apparatus of claim 4, wherein the fragrance is selected from the group consisting of lemon, citrus and pine.

7. An apparatus for cleaning an interior surface of a microwave oven comprising:

an enclosure disposed at feast partially around a surfactant solution compatible with food preparation, wherein the enclosure is breakable to enable delivery of the surfactant solution onto the interior surface of the microwave oven; and a cleaning article for effecting a cleaning process.

8. The apparatus of claim 7, wherein the enclosure comprises at least one material selected from the group consisting of plastic, paper, cardboard, glass, microwave-safe materials and combinations thereof.

9. The apparatus of claim 8, wherein the cleaning article is selected from the group consisting of a sponge, a cloth, paper, a towel, a paper towel, a shammy and combinations thereof.

10. The apparatus of claim 7, wherein the surfactant solution comprises at least one component selected from the group consisting of water, an emulsifier, a fragrance, an antibacterial agent and combinations thereof.

11. The apparatus of claim 10, wherein the surfactant solution comprises a surfactant at a concentration in a range from about 0.5% to about 50%.

12. The apparatus of claim 10, wherein the at least one component is a fragrance selected from the group consisting of lemon, citrus and pine.

13. A method for cleaning an interior surface of a microwave oven using a cleaning apparatus comprising a cleaning article and an enclosure containing a surfactant solution, comprising:

heating the cleaning apparatus with microwave energy by operating the microwave oven for a period to evaporate a portion of the surfactant solution while forming a vapor;

emitting the vapor from the enclosure into an interior of the microwave oven;

condensing at least a portion of the vapor onto the interior surface of the microwave oven for a second period to hydrate a residue adhered thereon; and removing the residue from the interior surface with the cleaning article.

14. The method of claim 13, wherein the period and the second period are each about 5 minutes.

15. The method of claim 13, wherein the cleaning article is selected from the group consisting of a sponge, a cloth, paper, a towel, a paper towel, a shammy and combinations thereof.

16. The method of claim 15, wherein the surfactant solution comprises at least one component selected from the group consisting of water, an emulsifier, a fragrance, an antibacterial agent and combinations thereof.

17. The method of claim 16, wherein the surfactant solution comprises a surfactant at a concentration in a range from about 0.5% to about 50%.

18. The method of claim 13, wherein the second period lasts for about 5 minutes.

19. A method for cleaning an interior surface of a microwave oven, comprising:

placing a cleaning apparatus in the microwave oven, wherein the cleaning apparatus comprises a cleaning article and a surfactant solution at least partially surrounded by an enclosure;

heating the cleaning apparatus for a time period;

evaporating at least a portion of the surfactant solution to form a vapor;

emitting the vapor from the cleaning apparatus;

condensing the vapor on the interior surface;

hydrating a residue adhered on the interior surface; and removing the residue from the interior surface with the cleaning article.

20. The method of claim 19, wherein the cleaning article is selected from the group consisting of a sponge, a cloth, paper, a towel, a paper towel, a shammy and combinations thereof.

21. The method of claim 20, wherein the surfactant solution comprises at least one component selected from the group consisting of an emulsifier, a fragrance, an antibacterial agent and combinations thereof.

22. The method of claim 21, wherein breaking a seal on the enclosure enables vapor delivery into the microwave oven.

23. The method of claim 19, further comprising:

operating the microwave oven to heat the cleaning apparatus for the time period; and allowing about 5 minutes after operating the microwave oven before removing the residue from the interior surface.

24. A method for cleaning a microwave oven interior surface, comprising:

placing a cleaning apparatus into a microwave oven, wherein the cleaning apparatus comprises a cleaning article, a surfactant solution and an enclosure at least partially enclosing the surfactant solution;

heating the cleaning apparatus to form a vapor from at least a portion of the surfactant solution;

delivering the vapor from the cleaning apparatus to the microwave oven interior surface;

loosening a residue adhered on the microwave oven interior surface; and removing the residue from the microwave oven interior surface with the cleaning article.

25. The method of claim 24, wherein the cleaning article is selected from the group consisting of a sponge, a cloth, paper, a towel, a paper towel, a shammy and combinations thereof.

26. The method of claim 25, wherein the surfactant solution comprises at least one component selected from the group consisting of water, an emulsifier, a fragrance, an antibacterial agent and combinations thereof.

27. The method of claim 26, wherein breaking a seal on the enclosure enables vapor delivery to the microwave oven interior surface.

28. The method of claim 24, further comprising:

operating the microwave oven to heat the cleaning apparatus for a first time period; and providing a second time period of about 5 minutes after operating the microwave oven and before removing the residue from the microwave oven interior surface.

29. An apparatus for cleaning an interior of a microwave oven comprising:

an enclosure disposed at least partially around a cleaning article for effecting a cleaning process and a surfactant solution compatible with food preparation, wherein the enclosure comprises at least one material selected from the group consisting of plastic, paper, cardboard, microwave-safe materials and combinations thereof, and the enclosure is breakable to enable fluid communication between the surfactant solution and the interior of the microwave oven.

30. An apparatus for cleaning an interior of a microwave oven comprising:

an enclosure disposed at least partially around a surfactant solution compatible with food preparation, wherein the enclosure is breakable to enable fluid communication between the surfactant solution and the interior of the microwave oven; and a cleaning article for effecting a cleaning process.

31. A method for cleaning a microwave oven interior surface, comprising:

placing a cleaning apparatus into a microwave oven, wherein the cleaning apparatus comprises a cleaning article, a cleaning solution and an enclosure at least partially surrounding the cleaning solution;

heating the cleaning apparatus to form a vapor from at least a portion of the cleaning solution;

delivering the vapor from the cleaning apparatus onto the microwave oven interior surface;

loosening a residue adhered on the microwave oven interior surface; and removing the residue from the microwave oven interior surface with the cleaning article.

32. The method of claim 31, further comprising breaking a seal on the enclosure to enable delivery of the vapor onto the microwave oven interior surface.

33. The method of claim 32, wherein the cleaning solution comprises at least one component selected from the group consisting of a surfactant, an emulsifier, a fragrance, an antibacterial agent and combinations thereof.

34. The method of claim 33, wherein the cleaning article is selected from the group consisting of a sponge, a cloth, paper, a towel, a paper towel, a shammy and combinations thereof.

35. The method of claim 32, wherein the cleaning solution comprises a fragrance and at least a second component selected from the group consisting of water, a surfactant, an emulsifier and combinations thereof.

36. The method of claim 35, wherein the fragrance is selected from the group consisting of lemon, citrus and pine.

37. The method of claim 31, further comprising:

operating the microwave oven to enable the heating the cleaning apparatus for a first time period; and providing a second time period of about 5 minutes after operating the microwave oven and before removing the residue from the microwave oven interior surface.

38. An apparatus for cleaning a microwave oven interior surface comprising:

an enclosure disposed at least partially around a cleaning solution comprising water and a fragrance, wherein the enclosure is breakable to enable release of the cleaning solution into a microwave oven interior; and a cleaning article for effecting a cleaning process, wherein the enclosure is disposed at least partially around the cleaning article.

39. The apparatus of claim 38, wherein the cleaning article is selected from the group consisting of a sponge, a cloth, paper, a towel, a paper towel, a shammy and combinations thereof.

40. The apparatus of claim 39, wherein the cleaning solution further comprises at least one component selected from the group consisting of a surfactant, an emulsifier, an antibacterial agent and combinations thereof.

41. The apparatus of claim 40, wherein the enclosure comprises at least one material selected from the group consisting of plastic, paper, cardboard, microwave-safe materials and combinations thereof.

42. The apparatus of claim 39, wherein the fragrance is selected from the group consisting of lemon, citrus and pine.

43. The apparatus of claim 42, wherein the at least one component is a surfactant at a concentration in a range from about 0.5% to about 50%.

44. The apparatus of claim 39, wherein the cleaning solution further comprises a surfactant and an emulsifier.

45. An apparatus for cleaning a microwave oven interior surface comprising:

an enclosure disposed at least partially around an aqueous cleaning solution comprising a fragrance, wherein the enclosure is breakable to enable fluid communication between the aqueous cleaning solution and the microwave oven interior surface; and a cleaning article for effecting a cleaning process.

46. The apparatus of claim 45, wherein the cleaning article is partially enclosed by the enclosure and selected from the group consisting of a sponge, a cloth, paper, a towel, a paper towel, a shammy and combinations thereof.

47. The apparatus of claim 46, wherein the fragrance is selected from the group consisting of lemon, citrus and pine.

48. The apparatus of claim 46, wherein the aqueous cleaning solution further comprises at least one component selected from the group consisting of a surfactant, an emulsifier, an antibacterial agent and combinations thereof.

49. The apparatus of claim 48, wherein the at least one component includes a surfactant at a concentration in a range from about 0.5% to about 50%.

50. The apparatus of claim 49, wherein the enclosure comprises at least one material selected from the group consisting of plastic, paper, cardboard, microwave-safe materials and combinations thereof.

51. An apparatus for cleaning a microwave oven interior surface comprising:

a cleaning article containing a cleaning solution comprising water and a fragrance and at least one component selected from the group consisting of a surfactant, an emulsifier, an antibacterial agent and combinations thereof; and an enclosure at least partially enclosing the cleaning article, wherein the enclosure is breakable to enable dispersion of the cleaning solution onto the microwave oven interior surface.

52. An apparatus for cleaning an interior surface of a microwave oven comprising:

a cleaning article for effecting a cleaning process of the interior surface of the microwave oven;

a cleaning solution comprising a surfactant which is compatible with food preparation and able to effect cleaning of the interior surface of the microwave oven; and an enclosure disposed at least partially around the cleaning article and the cleaning solution, wherein the enclosure is breakable to enable dispersion of the cleaning solution.

53. The apparatus of claim 52, wherein the enclosure comprises plastic.

54. The apparatus of claim 53, wherein the cleaning solution further comprises a fragrance.

55. An apparatus for cleaning an interior surface of a microwave oven comprising:

a surfactant solution compatible with food preparation at least partially enclosed by an enclosure that is breakable to enable dispersion of the surfactant solution onto the interior surface of the microwave oven; and a cleaning article for effecting a cleaning process disposed at least partially within the enclosure and at least partially saturated with the surfactant solution.

56. The apparatus of claim 55, wherein the surfactant solution further comprises a fragrance.

57. A kit for cleaning a microwave oven interior surface, comprising:

a cleaning apparatus comprising:

an enclosure disposed at least partially around a cleaning article for effecting a cleaning process, wherein the enclosure is breakable to enable dispersion of a cleaning solution comprising a surfactant and a fragrance into an interior of a microwave oven; and a set of directions comprising:

placing the cleaning apparatus into the microwave oven;

heating the cleaning apparatus by operating the microwave oven for a first period to evaporate a portion of the cleaning solution to form a vapor;

maintaining the microwave oven closed for a second period without operating the microwave oven to hydrate a residue adhered on the microwave oven interior surface; and removing the residue from the microwave oven interior surface with the cleaning article.

58. The kit of claim 57, wherein the second period lasts for about 5 minutes.

59. A kit for cleaning a microwave oven interior surface, comprising:

a cleaning apparatus comprising:

an enclosure disposed at least partially around a cleaning solution comprising a surfactant and a fragrance, wherein the enclosure is breakable to enable dispersion of the cleaning solution; and a cleaning article for effecting a cleaning process; and a set of directions comprising:

placing the cleaning apparatus into a microwave oven;

heating the cleaning apparatus by operating the microwave oven for a first period to evaporate a portion of the cleaning solution to form a vapor;

maintaining the microwave oven closed for a second period without operating the microwave oven to hydrate a residue adhered on the microwave oven interior surface; and removing the residue from the microwave oven interior surface with the cleaning article.

60. The kit of claim 59, wherein the second period lasts for about 5 minutes.

61. An apparatus for cleaning a microwave oven interior surface comprising:

a cleaning article selected from the group consisting of a sponge, a cloth, paper, a towel, a paper towel and a shammy;

a cleaning solution comprising a solvent and a fragrance, wherein upon being heated, a portion of the cleaning solution forms a cleaning vapor; and an enclosure at least partially enclosing the cleaning solution and the cleaning article, wherein the enclosure is breakable to enable dispersion of the cleaning vapor into a microwave oven interior.

62. The apparatus of claim 61, wherein the solvent is water.

63. An apparatus for cleaning a microwave oven interior surface comprising:

a heated cleaning liquid and a cleaning vapor formed from a cleaning solution comprising a solvent and a fragrance; and an enclosure at least partially enclosing the heated cleaning liquid and a cleaning article for effecting a cleaning process, wherein the enclosure is breakable to enable delivery of the cleaning vapor into a microwave oven interior.

64. The apparatus of claim 63, wherein the solvent is water.

65. An apparatus for cleaning an interior surface of a microwave oven, comprising:

a microwave-safe enclosure disposed at least partially around a wiping article moistened with an aqueous surfactant solution compatible with food preparation and comprising a fragrance, wherein the microwave-safe enclosure is breakable to enable fluid communication between the aqueous surfactant solution and the interior surface of the microwave oven.

66. A kit for cleaning an interior surface of a microwave oven, comprising:

a cleaning apparatus comprising:

a microwave-safe enclosure disposed at least partially around a wiping article moistened with a cleaning solution comprising a surfactant and a fragrance, wherein the microwave-safe enclosure is breakable to enable dispersion of the cleaning solution; and a set of directions comprising instructions to:

place the cleaning apparatus into a microwave oven;

heat the cleaning apparatus by operating the microwave oven to form a vapor from the cleaning solution for a first time period;

cool the cleaning apparatus after operating the microwave oven while keeping the microwave oven closed and loosening a residue adhered on an interior surface of the microwave oven for a second time period; and remove the residue from the interior surface with the wiping article.

67. The kit of claim 66, wherein the second time period lasts for about 5 minutes.

* * * * *